United States Patent [19]

DeWitt

[11] 4,389,742

[45] Jun. 28, 1983

[54] PRESSURE CONTROLLED AIR/WATER CUSHION

[76] Inventor: Nick R. DeWitt, 218 Windyam Dr., Portola, Calif. 94025

[21] Appl. No.: 222,207

[22] Filed: Jan. 2, 1981

[51] Int. Cl.[3] ..... A47C 27/08

[52] U.S. Cl. ..... 5/455; 5/441; 5/451

[58] Field of Search ..... 5/451, 441, 452, 449, 5/455, 450, 442; 297/DIG. 3

[56] References Cited

U.S. PATENT DOCUMENTS

| | | | |
|---|---|---|---|
| 3,148,389 | 9/1954 | Lustig | 5/442 |
| 3,298,044 | 1/1967 | Saltness et al. | 5/441 |
| 3,644,949 | 2/1972 | Diamond | 5/441 |
| 3,863,283 | 2/1975 | Mohr | 5/442 |
| 3,983,587 | 10/1976 | Gorran | 5/441 |
| 4,079,473 | 3/1978 | Phillips | 5/452 |
| 4,101,995 | 7/1978 | Phillips | 5/452 |
| 4,115,885 | 9/1978 | Davis | 5/451 |
| 4,247,963 | 2/1981 | Reddi | 5/441 |

FOREIGN PATENT DOCUMENTS

| | | | |
|---|---|---|---|
| 608951 | 2/1979 | Switzerland | 5/455 |
| 191459 | 1/1923 | United Kingdom | 5/455 |
| 572266 | 9/1977 | U.S.S.R. | 5/441 |

*Primary Examiner*—Alexander Grosz
*Attorney, Agent, or Firm*—Townsend & Townsend

[57] ABSTRACT

A cushion is disclosed having at least two coextensive overlying fluid compartments. One compartment is inflated with a compressible fluid, preferably air. The other compartment is inflated with a non-compressible fluid, preferably water. The compartments are provided with fluid communicated chambers defined between seams. The chambers and seams of an overlying compartment are at right angles to the chambers and seams of underlying compartments. Fluid communication is provided at apertures in the seams between the chambers. When inflated with water in one compartment, the air in the other compartment and supporting a user, the weight of the supported user is uniquely distributed by the two phase pressure reaction in each of the cushion compartments. Moreover, movement of the user produces a dual fluid phase hunting for a position of compressed equilibrium between the compartments and their respective chambers and seams in the cushion. Greater ease of body movement with a following cushion conformation occurs.

2 Claims, 4 Drawing Figures

PRESSURE CONTROLLED AIR/WATER CUSHION

This invention relates to the field of cushions utilized in health care and more particularly to a novel support cushion for distributing the reaction forces of a supported human, such as a crippled patient in a wheelchair.

Although the preferred embodiment of this invention finds particular advantageous use in the field of seat pads for wheelchair patients, it will be understood that the use of this invention can apply to any body support where comfort and health are of concern.

The problems of an invalid patient staying for long periods of time in a reclining or sitting position are well-known. For example, a patient in a wheelchair can develop decubitus ulcers in regions where bony prominences protrude from the body. Since ancient times, it has been known that cushions help. However, and as anyone may readily realize in shifting their weight on a conventional cushion support, there is no appreciable change of reaction forces exerted on the body. Where shifting with an underlying and supporting cushion occurs, the pressure points of cushion support remain substantially unchanged. In such cushion materials, the resilient or compressible material packs and eventually the entire cushion becomes firm enough so that the conformability and elasticity characteristics of the cushion are defeated. There occurs in confined and invalid patients resulting ulcers that are painful, dangerous with respect to infection, and extremely difficult to heal.

SUMMARY OF THE INVENTION

A cushion is disclosed having at least two coextensive overlying fluid compartments. One compartment is inflated with a compressible fluid, preferably air. The other compartment is inflated with a non-compressible fluid, preferably water. The compartments are provided with fluid communicated chambers defined between seams. The chambers and seams of an overlying compartment are at right angles to the chambers and seams of underlying compartments. Fluid communication is provided at apertures in the seams between the chambers. When inflated with water in one compartment, the air in the other compartment and supporting a user, the weight of the supported user is uniquely distributed by the two phase pressure reaction in each of the cushion compartments. Moreover, movement of the user produces a dual fluid phase hunting for a position of compressed equilibrium between the compartments and their respective chambers and seams in the cushion. Greater ease of body movement with a following cushion conformation occurs.

OBJECTS, FEATURES AND ADVANTAGES

An object of this invention is to disclose a cushion which has first and second overlying compartments. One compartment is filled with a non-compressible liquid, typically water. The other and preferably uppermost compartment is filled with a compressible fluid, such as air. Upon use of the pillow in the interstitial area between a support and a supported user, shifting of the body weight is facilitated on the pillow. Moreover, the pillow actively seeks fluid equilibrium upon shifting with a massaging effect.

A further object of this invention is to disclose a series of chambers within each compartment. Specifically, the chambers are defined between seams and provided with ports to fluidly communicate one chamber in a compartment with an adjacent chamber in the same compartment. Preferably, the chambers and seams in one compartment are crossed at 90° with respect to the chambers and seams of the other compartment.

An advantage of this aspect of the invention is that the fluid in communicating between the respective chambers seeks equilibrium with a massage-like action. Moreover, shifting of the body is not only easier but is encouraged. A rolling and shifting movement of the body is easily accomplished with each roll and shift producing a "massage" like re-centering of the body weight.

Other objects, features and advantages of this invention will become more apparent after referring to the following specification and attached drawings in which.

Figure 1:
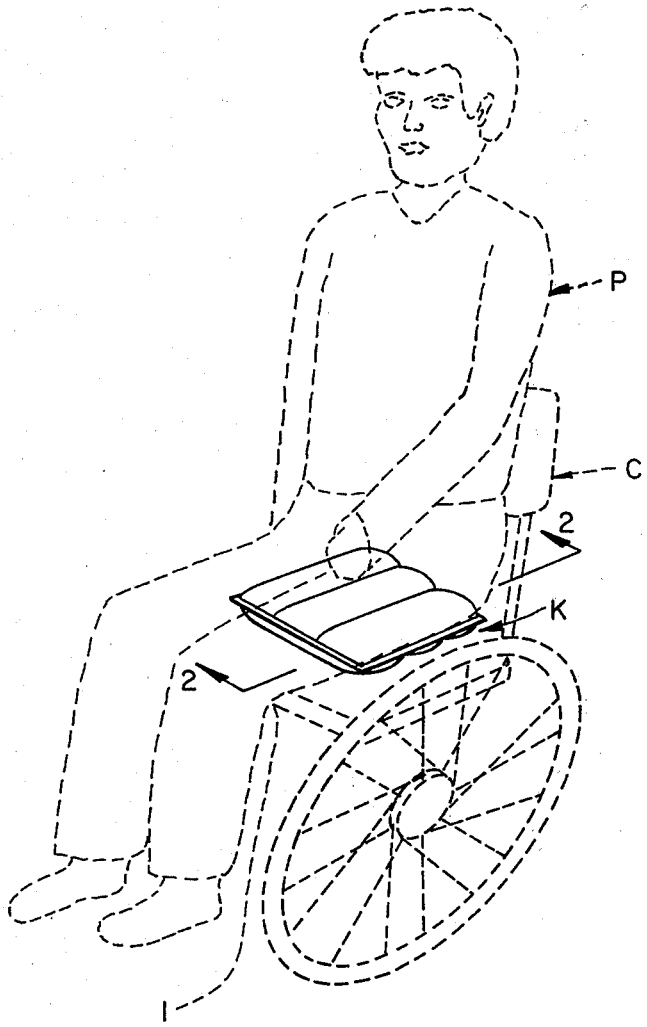
FIG. 1 is a perspective view of an invalid in a wheelchair with the cushion fitted between the interstitial area defining the bottom of the wheel chair seat and the patient.

Referring to FIG. 1, a patient P is illustrated in a wheelchair C. Between the chair bottom 1 and patient P, the cushion K of this invention is located.

In order to assist the understanding of this invention, the cushion will first be described with respect to FIGS. 2 and 3. Thereafter, the operation of the cushion will be set forth with particular attention being given to the dynamics which the cushion has in use.

Figure 2:
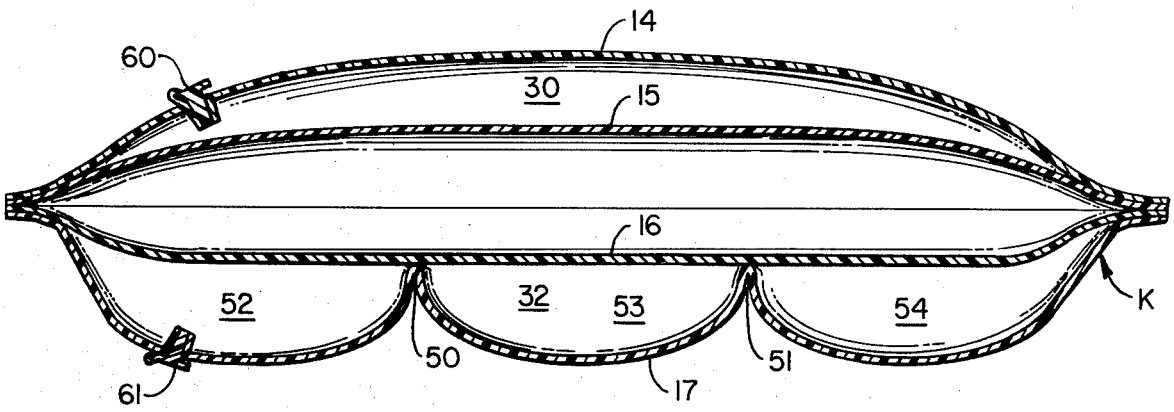
FIG. 2 is a side elevation section across the pillow along lines 2—2 of FIG. 1 illustrating the pillow and showing between the air chamber and water chamber an interstitial chamber for the placement of conventional pillows and/or other softening devices.
Figure 3:
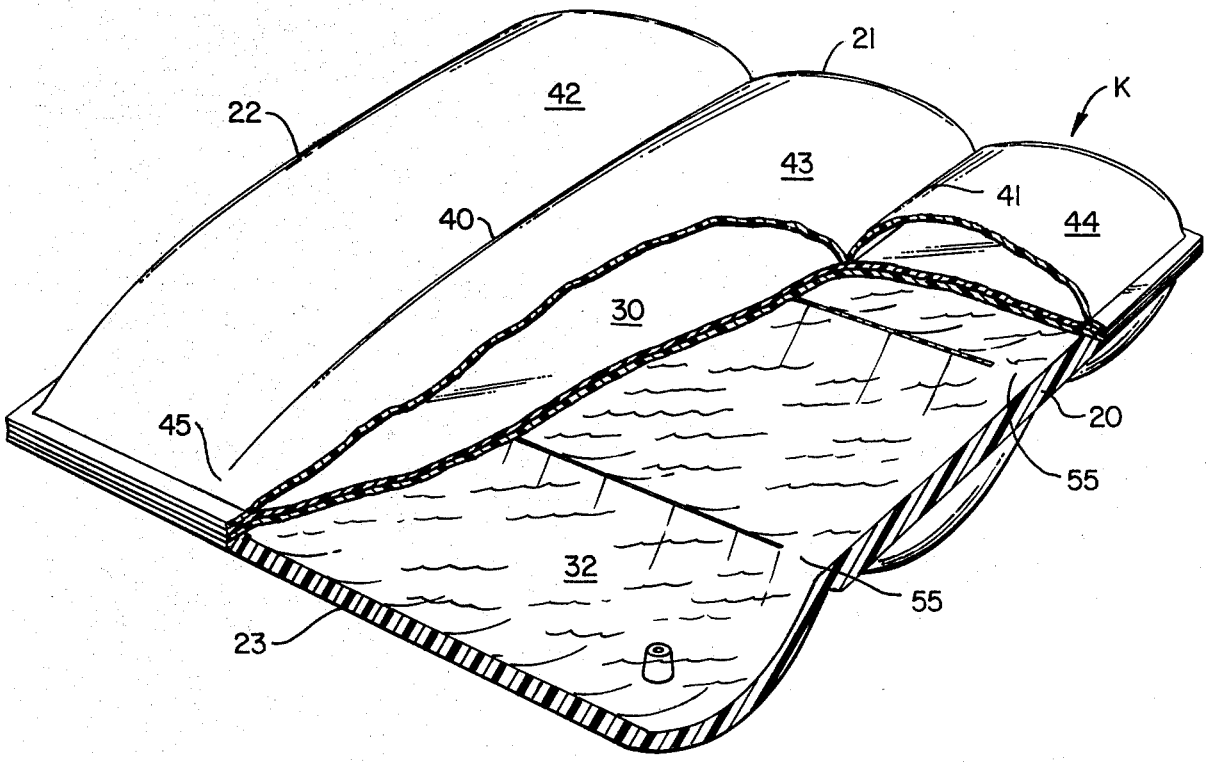
FIG. 3 is a picture of the pillow of FIG. 2 shown in a perspective view with the various membranes broken away, the interstitial area between the two chambers here being unoccupied by any intermedial object

Referring to FIGS. 2 and 3, it can be seen that each cushion is made from four overlying membranes. There is a first membrane 14, a second membrane 15, a third membrane 16 and a forth membrane 17. All the respective membranes are joined together at the side edges 20, 21, 22, and 23.

It may be easily said that membranes 14, 15 define a compartment 30 therebetween. Similarly, membranes 16, 17 define a compartment 32 therebetween.

Each of the compartments 30, 32 is provided with longitudinal seams. Seams 40 and 41 are provided across compartment 30 to define respective chambers 42, 43, 44.

The seams 40 and 41 are interrupted at ports. Specifically, the ports are usually located at either end of the seam and permit the transfer of fluid within a compartment between the respective chambers. For example, a port 45 illustrated in seam 40 permits fluid flow between chamber 42 and 43.

The ports in the chamber seams typically define an opening in the range of less than one quarter the overall length of the seam. In a preferred embodiment the ports occupy a lineal length approximately one tenth the length of the seam with opening of equal length at opposite ends of the seam.

The construction of the underlying compartment 32 is analogous. Specifically, seams 50 and 51 separate chambers 52, 53 and 54. A port 55 is located at the end of each seam and permits the communication of the water between the respective portions. Typically, conventional caps 60 and 61 are provided. These respective caps allow filling followed by subsequent sealing to occur.

It may be desired to leave the seam between membranes 15 and 16 open. In such an opening, conventional pillow material may be placed between the two membranes 15 and 16. It should be understood that this is optional and not required for the practice of this invention.

Moreover, four such membranes are here illustrated. The reason why four such membranes are included is that in the preferred embodiment, including the seams, practical seaming utilizing plastic and heat fusing seams at right angles can only occur when four such membranes are present. However, it will be understood by the reader that where alternate seaming techniques are utilized, as few as three seams could be used and the invention practiced as herein set forth.

Having discussed the construction, some attention can be given to the operation.

Typically, the fluid compartment 32 is filled with fluid of a non-compressible nature. Naturally and preferably, this is water. Filling occurs to a point where less than all of the compartment 32 was occupied but no substantial amount of fluid in another phase was present. In a preferred filling, the compartment 32 only holds water. It is purged of any air that may be present.

Filling of the air-filled side compartment 30 is similar. Typically, air is introduced so that the compartment 30 is less than full. For example, and in the actual use of the cushion herein described, it has been found that for heavier persons it is desirable to more fully inflate chamber 30; for lighter persons, greater portions of air can be released. Naturally, this can all occur at the discretion of the user.

Typically, the cushion is placed in the interstitial area between a supporting surface and a supported patient P. The support illustrated in FIG. 1 of a wheelchair is a typical use. It will be realized that the cushion could be located at other places. For example, it can be located behind the back. It also can be located to support a patient in a supine position.

The dynamic supporting effects which this invention provides can best be understood and is preferred in the sitting position to support the buttocks of a sitting patient. Comparison to a normally sitting person gives rapid understanding of this invention.

Sitting in a conventional and cushioned chair, a supported person rapidly finds that although he may shift the weight on his buttocks from side to side, the cushion still substantially uniformly resists the weight of his body at the point where the bony protuberances of the hips press downwardly through the buttocks and on to the chair. Sitting on a hard surface, such as a uncushioned church pew, intensifies this effect. Either on a conventional pillow or a hard and uncushioned church pew, there is little comfort afforded a sitting person when shifting of the weight occurs.

Cushions filled with soft and yielding material, such as cotton feathers or the like, provide a softened effect but still resists weight of the person seated at the bony protruberances. Moreover, such cushions become packed, conform to the body and eventually lose their original intended cushioning effect.

A single phase air cushion, such as an air mattress, water mattress, or the like, alleviates this effect somewhat. However, the phase of fluid within the cushion, be it all air or all water, merely conforms to the body. Pressure is distributed in a matter not unlike a stuffed cushion with only the hydraulic phenomena uniformly distributing the pressure throughout the cushion.

The multiphased two compartment cushion here described has a vastly different effect. First, and upon shifting of the weight from side to side on the cushion, rapid air movement occurs. This air movement occurs in chamber 30.

The movement of the water upon weight shifting in chamber 32 is retarded. This movement occurs with a dampening effect.

The sum of the fluid movements in chambers 30, 32 is gradual, takes a period of time to conform and in effect produces a massaging effect on the supported buttocks of the user of the cushion. Greater immediate comfort is apparent. Moreover, in use thus far, shifting of the body weight is not only easier, but is in fact encouraged by the use of the cushion. The combination of greater and more frequent body shifting with the massaging effect of the dual fluid phase of the cushion produces to the user an enhanced degree of comfort.

Emphasis has been given that the respective chambers have respective seams at right angles to one another in each of the compartments. For example, in compartment 30, chambers 42, 43 and 44 are divided by seams 40, 41. Likewise, and in compartment 32, chambers 52, 53 and 54 separated by their respective seams 50, 51 are at right angles to the same seams and chambers in compartment 30. This right angle disposition of the seams and chambers of each of the compartments has been found to be a material factor in affecting the massaging and gradual conforming action found to generate the beneficial comfort level of the cushion herein disclosed.

Figure 4:
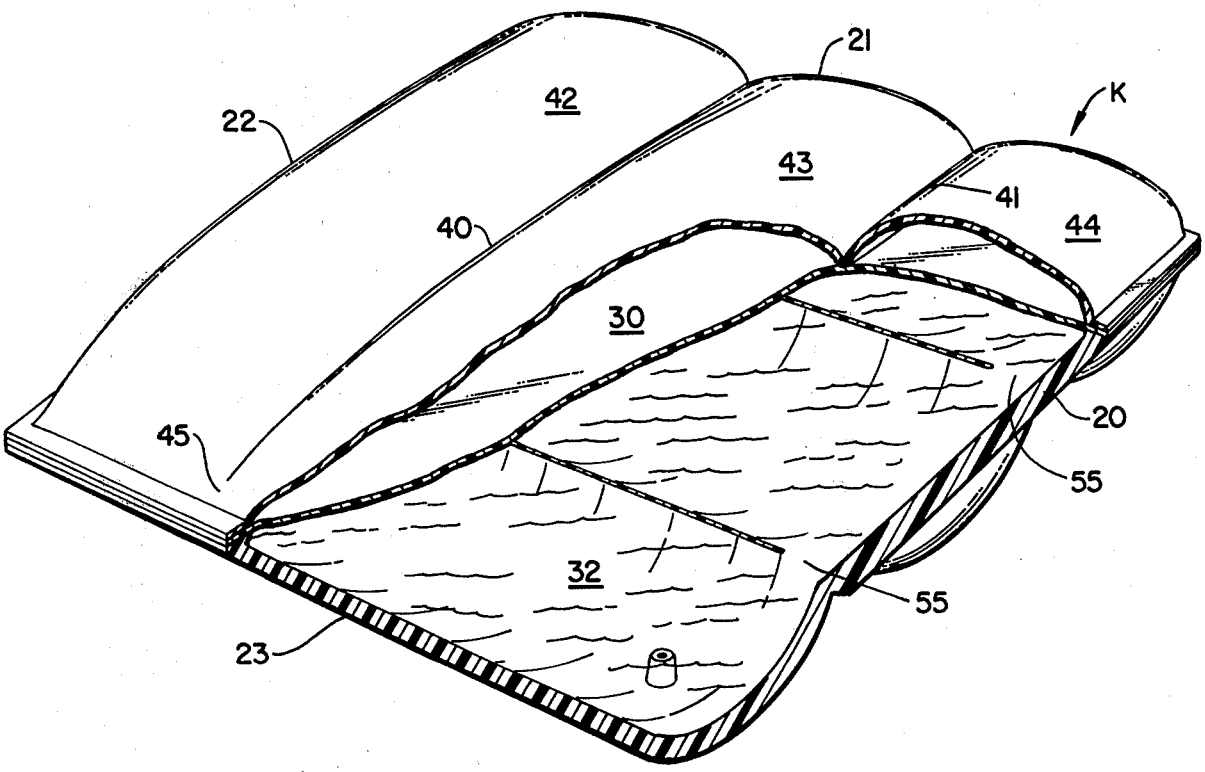
FIG. 4 is a picture of a pillow similar to that shown in FIG. 3 with portions of the various membranes broken away and having no interstitial area between the two chambers.

The reader will understand that in the view of FIG. 3, the boundary between chambers 30 and 32 can be occupied by a single membrane. Such an embodiment is specifically illustrated in the view of FIG. 4.

It will be apparent to the reader that modification may be made of the attached invention. For example, the number of chambers, seam, venting and the like can all be altered without departing from the spirit and scope of this invention.

What is claimed is:

1. A cushion for use between a support and a person seated on said support; the improvement in said cushion comprising first, second, and third membranes, said membranes covering an area sufficient to support said person in said seat, all said membranes joined at the side edges thereof to other membranes in a three-membrane cushion to form a first fluid tight compartment between said first and second membranes and a second fluid tight compartment between said second and third membranes; at least two substantially parallel seams in every compartment, wherein said seams within said first compartment are disposed at right angles to said seams in the second compartments, said seams dividing said compartments into at least three chambers, said seams including along one portion thereof an opening through said seams to permit fluid communication between chambers defined by the seams in the compartments on each side of said seams; said cushion at one of said compartments filled with water; said cushion at the other of said compartments filled with air.

2. A cushion for use between a support and a person seated on said support; the improvement in said cushion comprising first, second, third and fourth membranes, each said membranes covering an area sufficient to support said person in said seat, all said membranes joined at the side edges thereof to the other membranes to form a first fluid tight compartment between said first and second membranes and a second fluid tight compartment between said third and fourth membranes; at least two substantially parallel seams in every compartment, wherein said seams within said first compartment are disposed at right angles to said seams in the second compartment, said seams dividing said compartments into at least three chambers, said seams including along one portion thereof an opening through said seams to permit fluid communication between chambers defined by the seams in the compartments on each side of said seam; said cushion at one of said compartments filled with water; said cushion at the other of said compartments filled with air.

* * * * *